US009857134B1

(12) United States Patent
Karfiol et al.

(10) Patent No.: US 9,857,134 B1
(45) Date of Patent: Jan. 2, 2018

(54) FIREARM SEAR SAFETY

(71) Applicants: Yury Karfiol, Brooklyn, NY (US); Leslie Edelman, Englewood, NJ (US); John Goliber, Leonia, NJ (US)

(72) Inventors: Yury Karfiol, Brooklyn, NY (US); Leslie Edelman, Englewood, NJ (US); John Goliber, Leonia, NJ (US)

(73) Assignee: Kimber IP, LLC, Yonkers, NY (US)

( * ) Notice: Subject to any disclaimer, the term of this patent is extended or adjusted under 35 U.S.C. 154(b) by 634 days.

(21) Appl. No.: 13/909,675

(22) Filed: Jun. 4, 2013

Related U.S. Application Data

(60) Provisional application No. 61/820,476, filed on May 7, 2013.

(51) Int. Cl.
*F41A 17/50* (2006.01)
*F41A 17/56* (2006.01)

(52) U.S. Cl.
CPC ..... *F41A 17/56* (2013.01)

(58) Field of Classification Search
CPC ..... F41A 17/56; F41A 17/62; F41A 17/28
USPC .... 42/70.05, 70.04, 70.01; 89/148, 142, 150
See application file for complete search history.

(56) References Cited

U.S. PATENT DOCUMENTS

| | | | | |
|---|---|---|---|---|
| 1,523,831 | A * | 1/1925 | Karpinski | 89/148 |
| 4,414,769 | A | 11/1983 | Mueschke | |
| 4,512,100 | A * | 4/1985 | Dheur | 42/70.05 |
| 4,590,697 | A | 5/1986 | Ruger et al. | |
| 4,681,020 | A | 7/1987 | Polanecky | |
| 6,588,136 | B2 | 7/2003 | Baker et al. | |
| 8,132,496 | B2 | 3/2012 | Zukowski | |
| 8,333,028 | B1 | 12/2012 | Karfiol et al. | |

* cited by examiner

*Primary Examiner* — Reginald S Tillman, Jr.
(74) *Attorney, Agent, or Firm* — Caesar Rivise, PC

(57) ABSTRACT

A sear safety for a firearm is provided that includes a mode selection mechanism having a detent pin movable from an unlocked position to a locked position by a user. The sear includes a body having a first leg and a second leg. The body is pivotable about a pivot point between the first leg and the second leg. The sear has a first end surface on the first leg for contacting the firing element and a second end surface on the second leg for contacting a hard stop on the frame and for contacting the trigger bar. A pocket is on the second leg for receiving the detent pin when the detent pin is in the locked position to secure the sear against the hard stop. When the detent pin of is in the locked position, the sear is prevented from to rotating about its pivot point.

2 Claims, 10 Drawing Sheets

FIREARM SEAR SAFETY

CROSS-REFERENCE TO RELATED APPLICATION

This application claims priority to U.S. Provisional Application Ser. No. 61/820,476, entitled Firearm Sear Safety, filed on May 7, 2013.

SPECIFICATION

Background of the Invention

The present invention refers to a safety device for a sear mechanism for firearms. More particularly, the present invention is directed to a safety for firearms in which rotation of the sear of the firearm is prevented.

In semi-automatic firearms, a sear is a part of the trigger mechanism that holds the striker or hammer in position to fire until a designated amount of pressure is applied to the trigger. At this point, the striker or hammer is released, such that it springs forward to initiate discharge of the firearm.

Firearms in general may have one or more of numerous different types of safety mechanisms to prevent unintentional or accidental discharge of the firearm. One type of such safety mechanisms is a mechanism that prevents rotation of a sear.

Some types of sears are passive (i.e., internal or automatic) in that they do not require input from a user. Other types of sears are active (i.e., external or manual) which allow a user to provide input, for example, by moving a lever from an on position to an off position.

All references cited herein are incorporated herein by reference in their entireties.

BRIEF SUMMARY OF THE INVENTION

The present invention is directed to a sear safety for a semi-automatic pistol. The pistol has a manual safety mode selecting mechanism that includes a lever, pivot pin and detent pin which is generally parallel to the pivot pin. The mechanism has two or more detent positions where the lever engages or disengages the sear. When a user moves the lever to engage the sear, the safety is activated such that the sear cannot move.

The mechanism reduces or avoids "dead zones" between the engaged and disengaged positions.

A sear safety for a firearm is provided where the firearm has a frame, a trigger bar, and a firing element. The sear safety includes a mode selection mechanism having a detent pin movable from a first unlocked position to a second locked position. The detent pin extends through the frame to facilitate manual switching between the first unlocked and second locked positions by a user. The sear includes a body having a first leg and a second leg. The body is pivotable relative to the frame about a pivot point disposed between the first leg and the second leg. The sear has a first end surface on the first leg for contacting the firing element and a second end surface on the second leg for contacting a hard stop on the frame and for contacting the trigger bar. A pocket is disposed on the second leg for receiving the detent pin when the detent pin is in the second, locked position to secure the sear against the hard stop. When the detent pin of the mode selection mechanism is in the second, locked position, the sear is prevented from to rotating about its pivot point.

The firing element may have a main body and a tab depending from the main body where the tab has a surface for contacting the sear.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
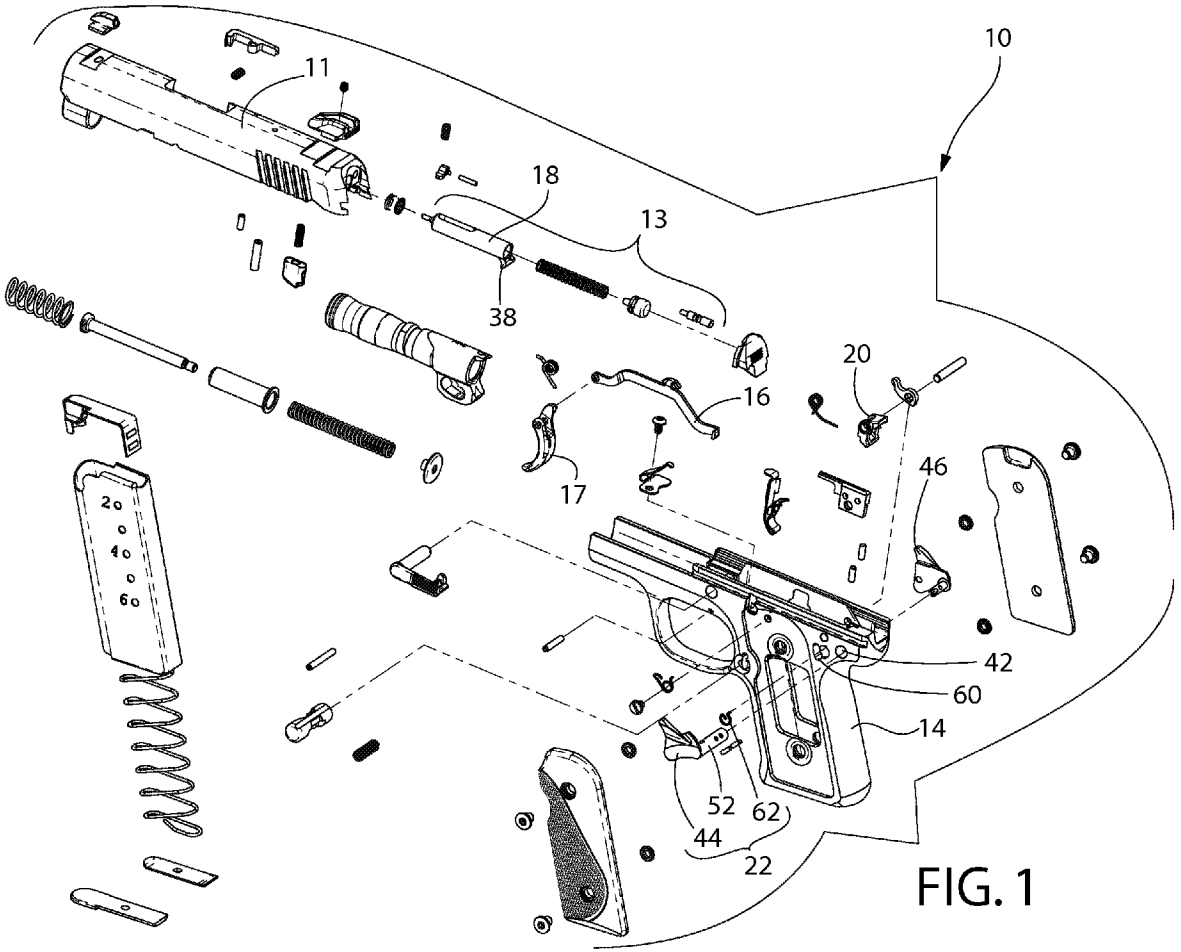
FIG. 1 is an exploded isometric view of a firearm having a sear safety in accordance with an Exemplary embodiment of the present invention.
Figure 2:
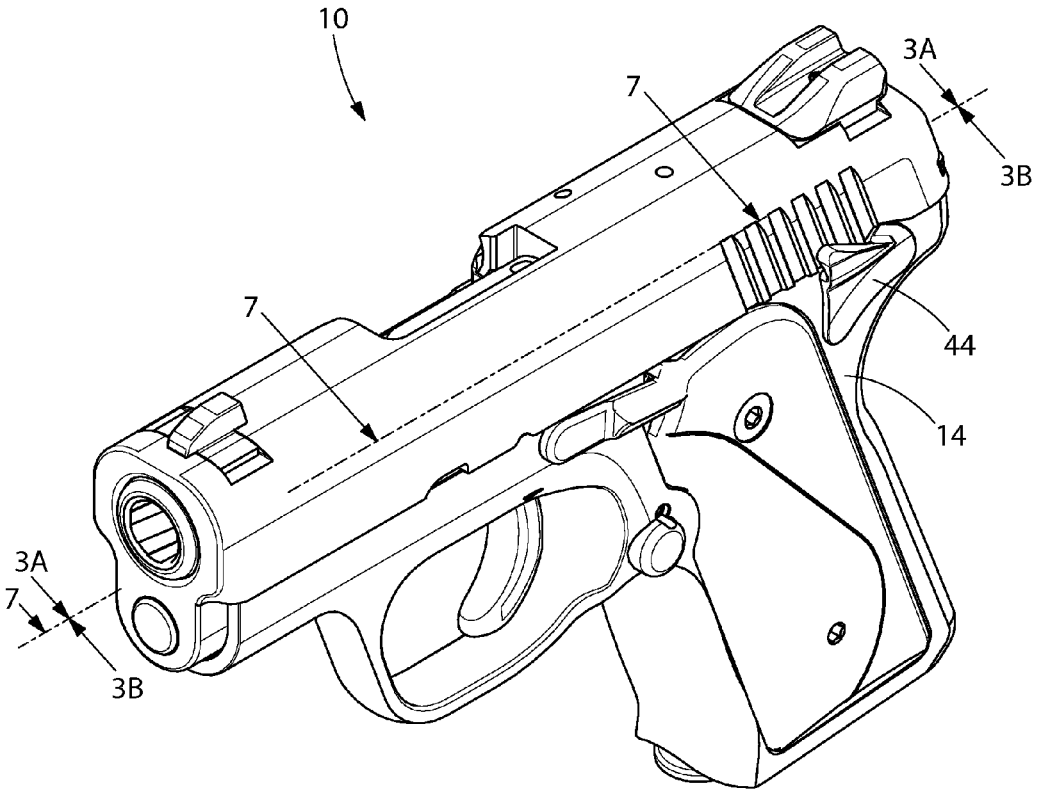
FIG. 2 is an isometric view of the firearm of FIG. 1.
Figure 3A:
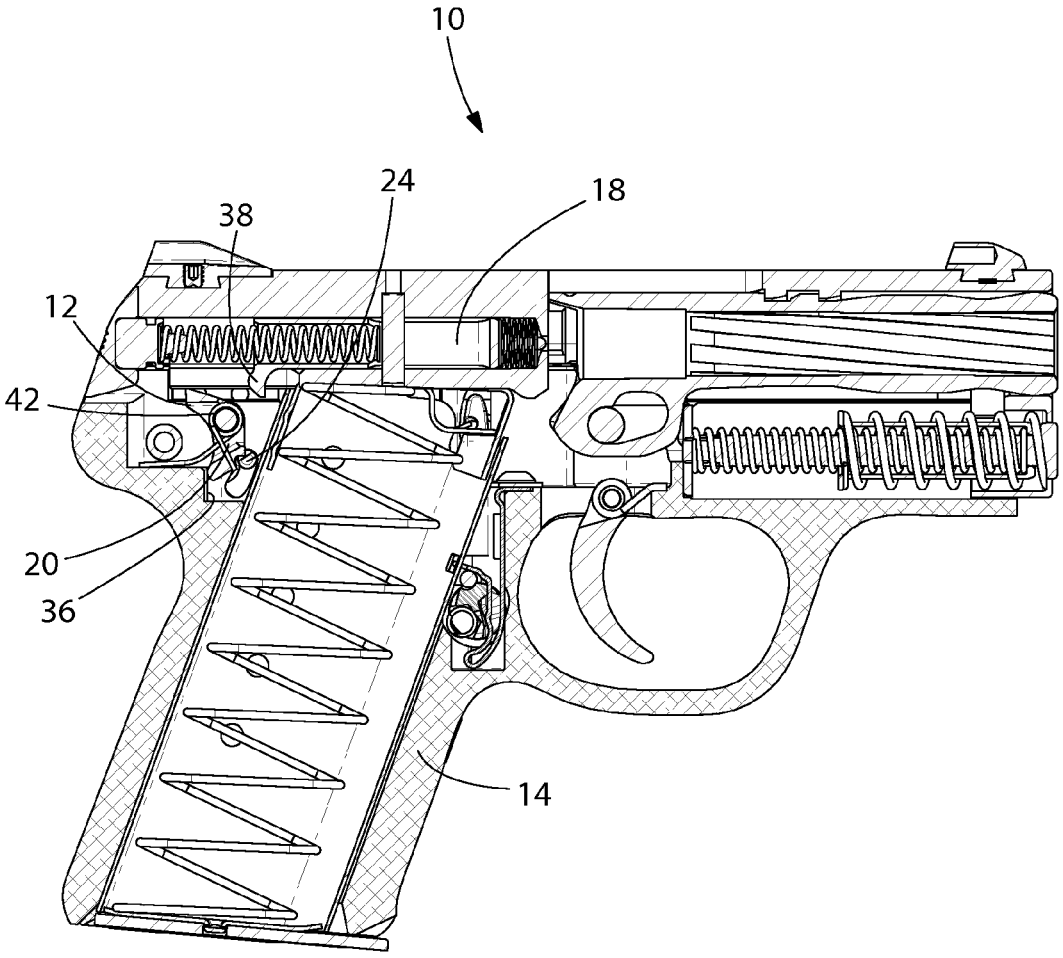
FIG. 3A is a cross-sectional view of the firearm having the sear safety of FIG. 1, taken substantially along lines 3A-3A of FIG. 2.
Figure 3B:
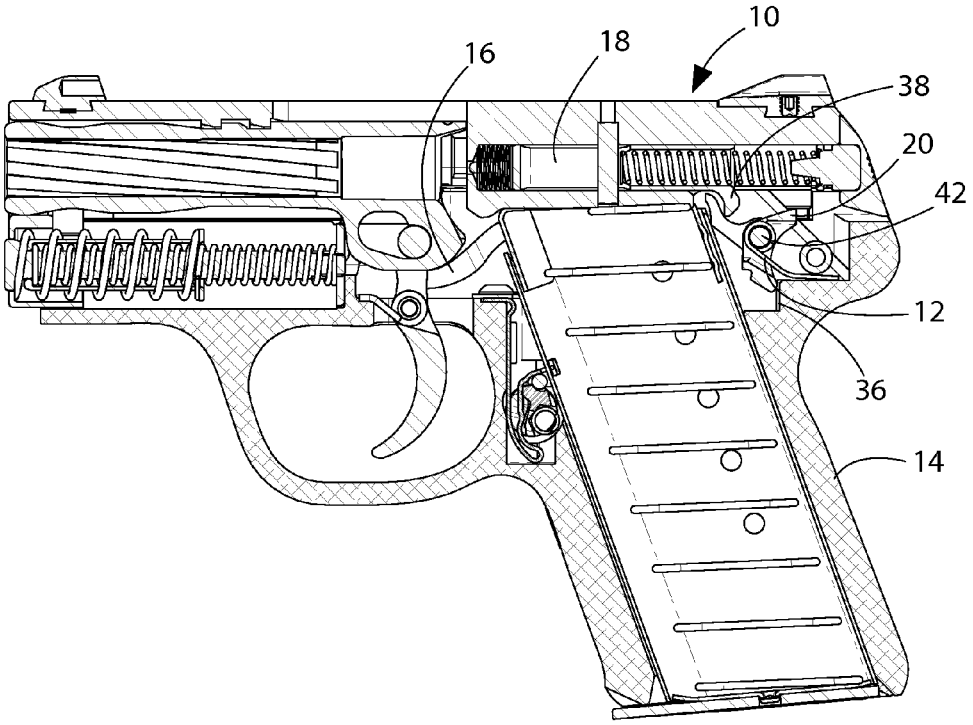
FIG. 3B is a cross-sectional view of the firearm having the sear safety of FIG. 1, taken substantially along lines 3B-3B of FIG. 2.

The invention will be illustrated in more detail with reference to the following embodiments, but it should be understood that the present invention is not deemed to be limited thereto.

Referring now to the drawing figures, wherein like part numbers refer to like elements throughout the several views, there is shown in FIGS. 1, 2, 3A and 3B a firearm 10 having a sear safety 12 in accordance with an exemplary embodiment of the present invention. The firearm 10 has a frame 14, a trigger bar 16, a trigger 17, a firing pin mechanism 13, a firing element 18 (e.g., a firing pin, a striker, or the like), a slide 11, a barrel 15, as well as other elements. The sear safety 12 utilizes a sear 20 having unique features in accordance with the present invention. See FIGS. 4-6. The sear safety 12 includes a mode selection mechanism 22, best seen in FIG. 13, that utilizes a detent pin 24 that is moveable from a first unlocked position A to a second locked position B. See FIG. 7. The detent pin 24 extends through the frame 14 to facilitate manual switching by a user of the firearm between the first unlocked position A (see FIGS. 8-12) and second locked position B (see FIG. 3A) by the user. The detent mechanism may be of the type disclosed in U.S. Pat. No. 8,333,028 (Karfiol et al.), the complete specification of which is fully incorporated by reference.

Figure 4:
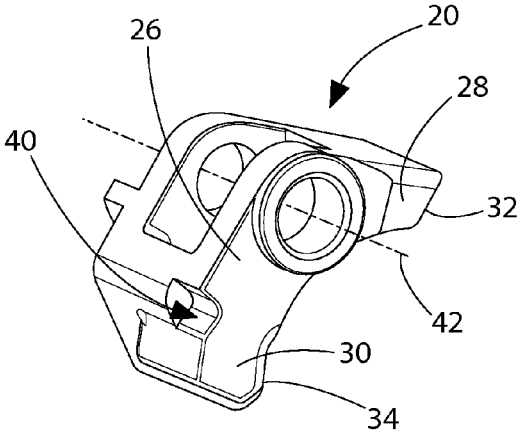
FIG. 4 is a is a an isometric view of a sear of the firearm having a sear safety of FIG. 1.
Figure 5:
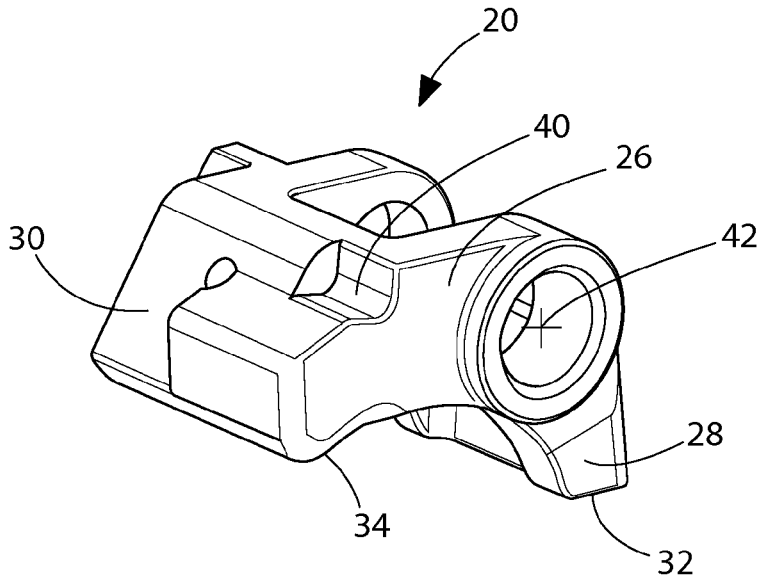
FIG. 5 is another isometric view of the sear of FIG. 4.
Figure 6:
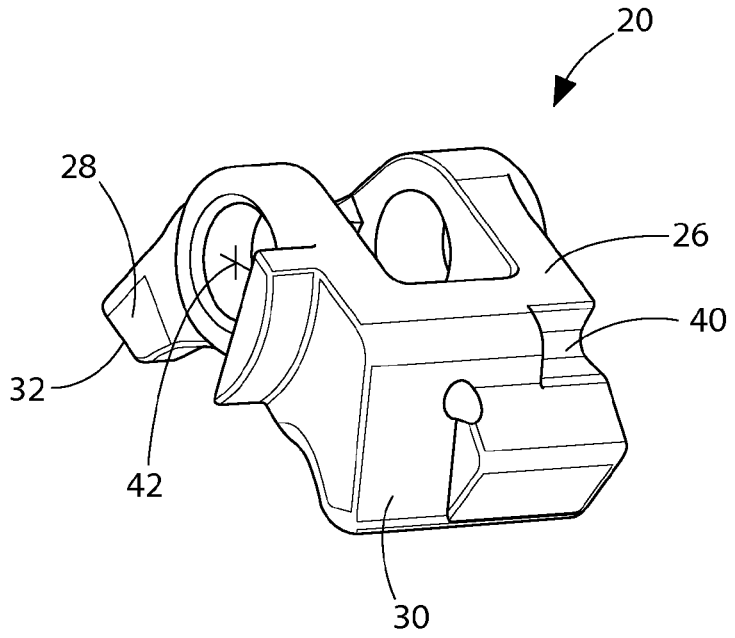
FIG. 6 is another isometric view of the sear of FIG. 4.
Figure 7:
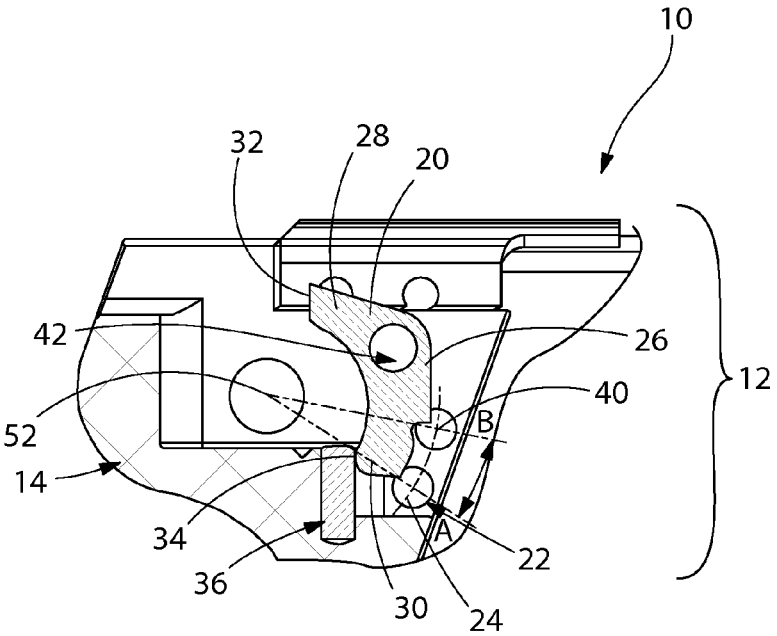
FIG. 7 is a partial cross sectional view of the firearm of FIG. 2, taken substantially along lines 7-7 of FIG. 2, with the slide and related elements removed for clarity.
Figure 8:
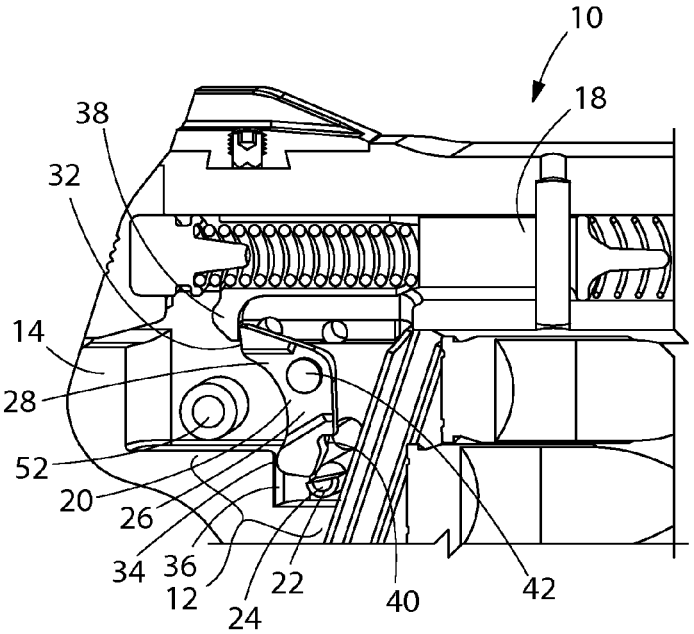
FIG. 8 is a partial, cross-sectional view of the firearm of FIG. 1, taken substantially along lines 7-7 of FIG. 2.
Figure 9:
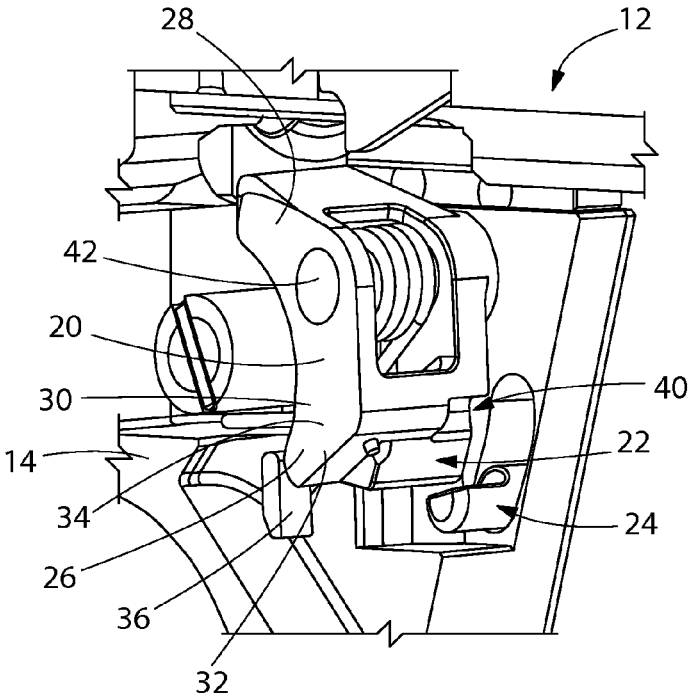
FIG. 9 is a partial isometric, cross-sectional view of a portion of the firearm of FIG. 1, with various elements removed for clarity.
Figure 10:
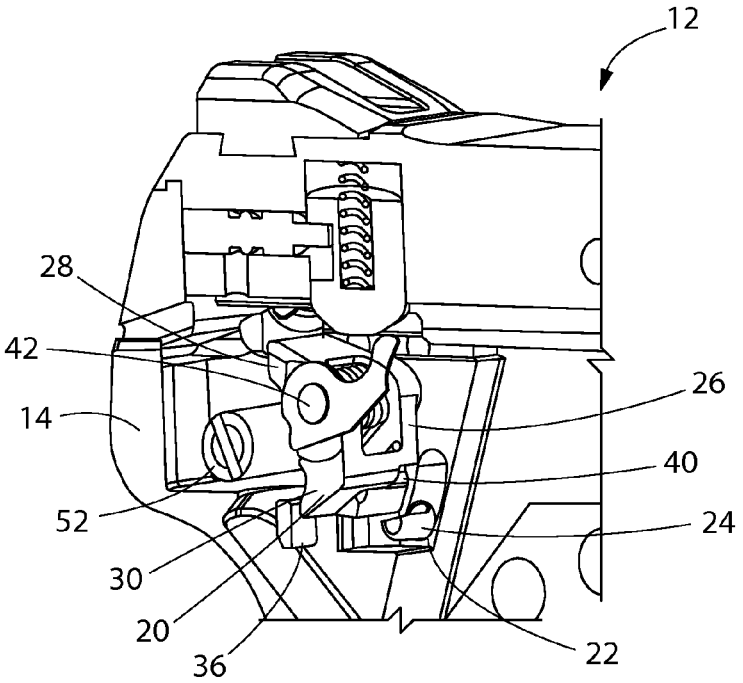
FIG. 10 is another isometric, cross-sectional view of a portion of the firearm of FIG. 1, with various elements removed for clarity.
Figure 11:
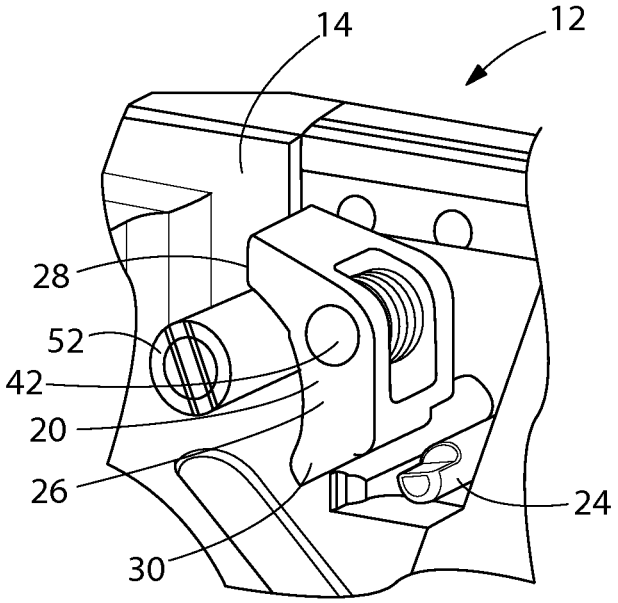
FIG. 11 is another isometric, cross-sectional view of a portion of the firearm of FIG. 1, with various elements removed for clarity.
Figure 12:
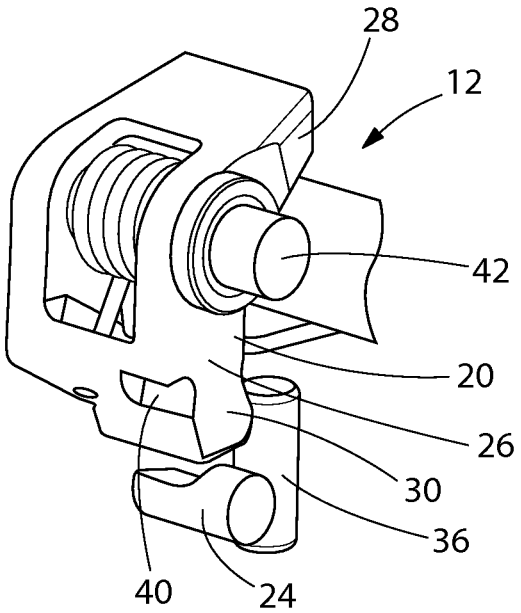
FIG. 12 is an isometric view of the sear and related elements of the firearm of FIG. 1.

The sear 20 includes a body 26 having a first leg 28 and a second leg 30. The sear 20 is pivotable relative to the frame 14 about a pivot point 42 disposed between the first leg 28 and the second leg 30. As can be seen in FIGS. 4-6, the sear 20 has a first end surface 32 on the first leg 28 for contacting a tab 39 (i.e., a nose) that depends from the firing element 18. The sear 20 has a second end surface 34 on the second leg 30 for contacting a hard stop 36 on the frame 14 and for contacting the trigger bar 16. Whether the sear 20 contacts the hard stop 36 or the trigger bar 16 depends upon the state of the firing state of the firearm 10.

Again, as best can be seen in FIG. 4-6, the sear 20 has a pocket 40 disposed on the second leg 30 of the sear 20 for receiving the detent pin 24 when the detent pin 24 is in the second, locked position B, to secure the sear 20 against the hard stop 36. This second, locked position B secures the sear 20 such that it is unable to rotate about its pivot point 42.

Figure 13:
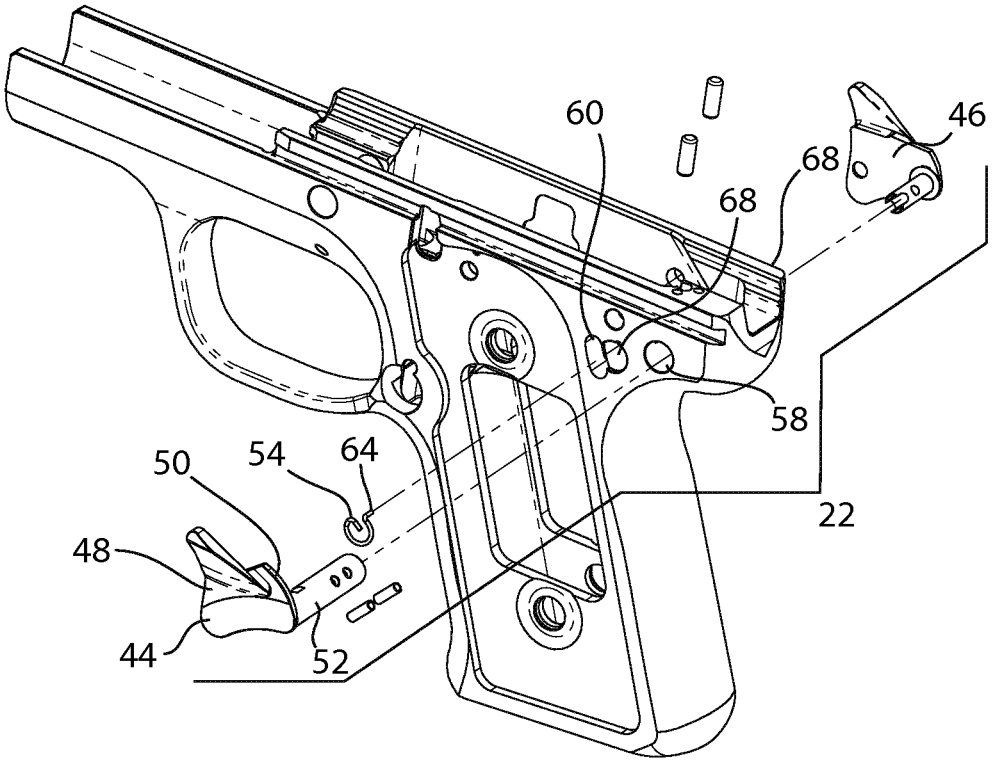
FIG. 13 is an isometric view of a portion of the firearm of FIG. 1, depicting the mode selection mechanism, with various elements removed for clarity.
Figure 14:
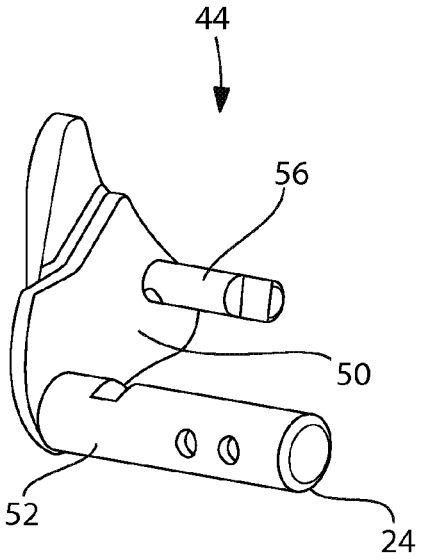
FIG. 14 is an isometric view of a lever of the mode selection mechanism of the firearm of FIG. 1.
Figure 15:
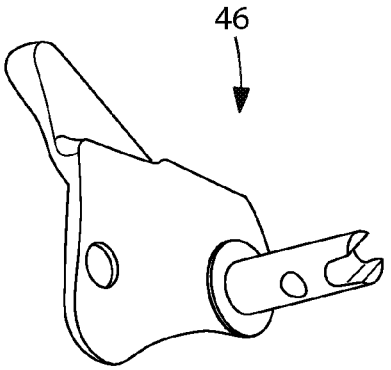
FIG. 15 is an isometric view of an ambidextrous lever portion of the mode selection mechanism of the firearm of FIG. 1.

As seen in FIG. 13, the mode selection mechanism 22 includes a lever 44 (see FIG. 14) and flexible stop 54 (see FIG. 16), optional ambidextrous lever portion 46 (see FIG. 15) and related features of the frame 14. The lever 44 has an exposed surface 48 (see FIG. 13) that is disposed on the exterior of the frame 14 for receiving a thumb (or any other digit) of a user. Depending from the inner surface 50 of the lever 44 are two pins, a pivot pin 52 and a detent pin 24. The pivot pin 52 is generally circular in cross section and extends through a round orifice 58 in the frame 12 located in a convenient and accessible position to a user. The detent pin 24 extends generally parallel to the pivot pin 52. In the frame 14, adjacent to the round orifice 58, is an arc-shaped aperture 60 that receives the detent pin 24 of the lever 44.

The lever 44 is pivotable about the pivot pin 52 in the round orifice 58 from a first position to a second position wherein the detent pin 52 moves in the arc-shaped aperture 60. That is, pivotable movement of the lever 44 is limited by the detent pin 24 being captured within the arc-shaped aperture 60 of the frame 14. When the lever 44 is in the first position, the detent pin 24 is at a first position A in the arc-shaped aperture 60. When the lever 44 is in the second position, the detent pin 24 is at the second position B in the arc-shaped aperture 60. See FIG. 7.

Figure 16:
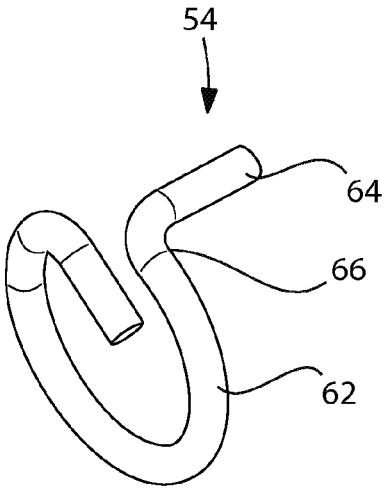
FIG. 16 is an isometric view of a flexible stop of the mode selection mechanism of the firearm of FIG. 1.

The flexible stop 54 is provided as shown in detail in FIG. 16. Essentially, the flexible stop 54 is a ring 52 made from a spring metal that has an integral leg 54 depending from an end 66 of the ring 62. The leg 64 is preferably generally perpendicular to the ring 62 and is used to secure the flexible stop 54 in a proper position in the frame 14 adjacent to the lever 44 and its arc-shaped aperture 60. The flexible stop 34 is disposed in a ring orifice 68 in the frame 14. The flexible stop 54 is generally secured in the ring orifice 68, but retains the ability to compress generally in a plane of the ring 62.

The detent pin 24 of the lever 44 is disposed against the ring 62 of the flexible stop 54 wherein, as the lever 44 is moved from the first position to the second position, and as the lever 44 is moved from the second position to the first position, the flexible stop 54 compresses somewhat and then uncompresses, thereby creating a detent wherein the lever snaps as it moves between the positions.

While the invention has been described in detail and with reference to specific examples thereof, it will be apparent to one skilled in the art that various changes and modifications can be made therein without departing from the spirit and scope thereof.

What is claimed is:

1. A sear safety in combination with a firearm, the firearm having a frame, a trigger bar, and a firing element, the sear safety comprising:

(a) a mode selection mechanism having a detent pin movable from a first unlocked position to a second locked position, the detent pin extending through the frame to facilitate manual switching between the first unlocked and second locked positions by a user, the mode selection mechanism comprising;

(i) a lever having an exposed surface for receiving a digit of a user and an inner surface, a pivot pin and the detent pin depending from the inner surface, the pivot pin extending through an orifice in the frame, the detent pin extending generally parallel to the pivot pin, the lever pivotable from a first position to a second position about the pivot pin, wherein the detent pin moves in an arc-shaped aperture, wherein, when the lever is in the first position, the detent pin is at a first position in the arc-shaped aperture and when the lever is in the second position, the detent pin is at a second position in the arc-shaped aperture;

(ii) a flexible stop comprising an open ring of spring metal disposed in a ring orifice in the frame, wherein the flexible stop is secured in the ring orifice, but retaining an ability to compress in a plane of the ring; and (iii) the detent pin disposed against the flexible stop wherein, as the lever is moved from the first position to the second position, and as the lever is moved from the second position to the first position, the flexible stop compresses and then uncompresses thereby creating a detent wherein the lever snaps as it moves between the positions; and (b) a sear comprising:

(i) a body having a first leg and a second leg, the body pivotable relative to the frame about a pivot point disposed between the first leg and the second leg;

(ii) the sear having a first end surface on the first leg for contacting the firing element;

(iii) the sear having a second end surface on the second leg for contacting a hard stop on the frame; and (iv) a pocket disposed on the second leg for receiving the detent pin when the detent pin is in the second, locked position, to secure the sear against the hard stop, said pocket having a three-dimensional concave shape with a back wall perpendicular to an axis of the detent pin for receiving at least a portion of the detent pin within said pocket;

whereby, when the detent pin of the mode selection mechanism is in the second, locked position, the sear is prevented from to rotating about its pivot point.

2. The sear safety for a firearm, wherein the firing element has a main body and a tab depending from the main body, the tab having a surface for contacting the sear.

* * * * *